US009975177B2

(12) United States Patent
Noda et al.

(10) Patent No.: US 9,975,177 B2
(45) Date of Patent: May 22, 2018

(54) METHOD FOR A POURING CONTROL AND A STORAGE MEDIUM FOR STORING PROGRAMS FOR CAUSING A COMPUTER TO CARRY OUT A PROCESS FOR CONTROLLING POURING

(71) Applicants: NATIONAL UNIVERSITY CORPORATION UNIVERSITY OF YAMANASHI, Yamanashi (JP); SINTOKOGIO, LTD., Aichi (JP); NATIONAL UNIVERSITY CORPORATION TOYOHASHI UNIVERSITY OF TECHNOLOGY, Aichi (JP)

(72) Inventors: Yoshiyuki Noda, Kofu (JP); Takaaki Tsuji, Kofu (JP); Makio Suzuki, Toyokawa (JP); Kazuhiko Terashima, Toyohashi (JP)

(73) Assignees: National University Corporation University of Yamanashi, Yamanashi (JP); Sintokogio, Ltd., Aichi (JP); National University Corporation Toyohashi University of Technology, Aichi (JP)

( * ) Notice: Subject to any disclaimer, the term of this patent is extended or adjusted under 35 U.S.C. 154(b) by 197 days.

(21) Appl. No.: 14/785,921

(22) PCT Filed: Mar. 27, 2014

(86) PCT No.: PCT/JP2014/058802

§ 371 (c)(1),
(2) Date: Oct. 21, 2015

(87) PCT Pub. No.: WO2014/174977

PCT Pub. Date: Oct. 30, 2014

(65) Prior Publication Data

US 2016/0096222 A1 Apr. 7, 2016

(30) Foreign Application Priority Data

Apr. 27, 2013 (JP) ..... 2013-094810

(51) Int. Cl.
*B22D 37/00* (2006.01)
*F27D 3/14* (2006.01)
(Continued)

(52) U.S. Cl.
CPC ..... *B22D 37/00* (2013.01); *B22D 39/00* (2013.01); *B22D 41/06* (2013.01); *F27D 3/14* (2013.01);
(Continued)

(58) Field of Classification Search
CPC ..... B22D 37/00; B22D 39/00; B22D 41/06; F27D 19/00; F27D 2019/0028; F27D 3/14
(Continued)

(56) References Cited

U.S. PATENT DOCUMENTS 6,576,039 B2 * 6/2003 Koffron ..... B22D 37/00 266/236

FOREIGN PATENT DOCUMENTS

CN 1183065 A 5/1998
EP 2140955 A1 1/2010
(Continued)

OTHER PUBLICATIONS

Office Action for CN Application No. 201480018267.1, dated Jul. 1, 2016, (2 pages).

(Continued)

*Primary Examiner* — Scott Kastler
*Assistant Examiner* — Michael Aboagye
(74) *Attorney, Agent, or Firm* — Finnegan, Henderson, Farabow, Garrett & Dunner, LLP

(57) ABSTRACT

To enable a ladle-tilting automatic pouring device to take less time for identification of the parameters and the device
(Continued)

to pour highly precisely by sequentially updating pouring model parameters according to the pouring situation, the present pouring control method is based on a mathematical model of a process from input of control parameters to pouring of molten metal, the method including: identifying, using an optimization technique, a flow rate coefficient, a liquid density, and a pouring start angle that is a tilting angle of the pouring ladle when the flowing of the molten metal starts, which are the control parameters in the mathematical model, based on weight of liquid that flows out of the pouring ladle and tilting angle of the ladle that are measured during pouring, and a command signal that controls the tilting of the pouring ladle; and updating the control parameters to the identified control parameters.

4 Claims, 5 Drawing Sheets

(51) Int. Cl.
*B22D 39/00* (2006.01)
*F27D 19/00* (2006.01)
*B22D 41/06* (2006.01)

(52) U.S. Cl.
CPC ..... *F27D 19/00* (2013.01); *F27D 2019/0028* (2013.01)

(58) Field of Classification Search
USPC ..... 266/44, 45, 78, 90, 96, 99, 236; 222/590, 604
See application file for complete search history.

(56) References Cited

FOREIGN PATENT DOCUMENTS

| | | |
|---|---|---|
| JP | 3537012 | 6/2004 |
| JP | 2005-088041 | 4/2005 |
| JP | 2007-275934 | 10/2007 |
| JP | 2008-290148 | 12/2008 |
| JP | 4328826 | 9/2009 |
| JP | 4496280 | 7/2010 |
| JP | 2010-253527 | 11/2010 |

OTHER PUBLICATIONS

Extended European Search Report for corresponding EP Application No. 14787473.9 dated Nov. 17, 2016 (6 pages).
English-language International Search Report corresponding to PCT/JP2014/058802, from the Japanese Patent Office dated Jun. 24, 2014.

* cited by examiner

METHOD FOR A POURING CONTROL AND A STORAGE MEDIUM FOR STORING PROGRAMS FOR CAUSING A COMPUTER TO CARRY OUT A PROCESS FOR CONTROLLING POURING

TECHNICAL FIELD

The present invention is related to a pouring control method and a medium that is readable by a computer in which a program is stored. The program causes the computer to carry out a process for controlling pouring, in an automatic pouring device with a tilting-type pouring ladle that pours the molten metal into a mold by tilting the pouring ladle that holds the molten metal.

BACKGROUND OF THE DISCLOSURE

Conventional pouring control methods with an automatic pouring device with a tilting-type ladle are shown as follows: Patent document 1 discloses a method for storing data on a pouring flow rate that is obtained when the operator pours the molten metal (outflow weight from the pouring ladle per unit of time). The ladle tilting angular speed is adapted such that the pouring flow rate by the automatic pouring device is equal to the pouring flow rate by the operator. Patent document 2 discloses a method for achieving a relationship between the ladle tilting angle and the pouring flow rate from the result of preliminary test pouring experiments and adjusting the ladle tilting angle to achieve a desirable pouring flow rate pattern. Patent document 3 discloses a method for carrying out a feedback control such that the level of the surface of the liquid at the sprue of the mold is constant.

However, these pouring control methods require many test pouring experiments to determine control parameters. In particular, since the relationship between the control parameters and the physical parameters (the shape of the pouring ladle, the flow rate coefficient, and the liquid density) related to the pouring process is unclear, similar test pouring experiments are required for the pouring process where a different type of shape of the pouring ladle and a different type of liquid to be poured are used. In addition, if the test pouring experiments and the pouring environment change, for example, a characteristic variation of the liquid to be poured due to the decrease in temperature of the molten metal, etc., and/or the variation of the shape of the pouring ladle caused by accumulating slag, occurs, then a decrease in the accuracy of the pouring becomes a problem.

For this reason, the inventors of the present invention derived the mathematical model of the pouring process based on fluid mechanics, and developed the model-based pouring control system (Patent documents 4 and 5). It was a pouring control system based on that model. Since the relationship between the physical parameters and control parameters of the pouring process in that control system is clear, even the small number of pouring experiments allowed one to build the control system for the automatic pouring device where a different type of shape of the pouring ladle and a different type of liquid to be poured are used.

CITATION LIST

Patent Document

[Patent document 1] Japanese Granted Patent Gazette No. 4565240

[Patent document 2] Japanese Granted Patent Gazette No. 3537012

[Patent document 3] Japanese Granted Patent Gazette No. 4282066

[Patent document 4] Japanese Granted Patent Gazette No. 4328826

[Patent document 5] Japanese Granted Patent Gazette No. 4496280

SUMMARY OF INVENTION

Problems to be Resolved

However, even in those pouring control systems a plurality of test pouring experiments are required because the flow rate coefficient, the liquid density, and the pouring start angle from the pouring ladle, which are the parameters of the model of pouring the molten metal, must be identified beforehand. Moreover, although the value of the parameters may possibly vary by the variation in the pouring conditions due to the variations in the temperature of the pouring and accumulating slag, the systems cannot cope with any variation that occurs after the pouring experiments have been completed. So the accuracy of the pouring may be reduced.

Thus, the objects of the present invention are to provide a pouring control method and a medium that is readable by a computer in an automatic pouring device with a tilting-type pouring ladle, where the operation for identification of the parameters, which normally takes much time to complete, can take less time. The device sequentially updates the parameters of the pouring model depending on the pouring conditions and pours the molten metal with a high degree of accuracy.

Means for Solving the Problem

To achieve the above-mentioned object, an embodiment of the present invention provides a pouring control method for controlling pouring based on a mathematical model of a pouring process from the input of the control parameters to the pouring of the molten metal. The present invention uses a pouring ladle in an automatic pouring device with a tilting-type pouring ladle that pours the molten metal into a mold by tilting the pouring ladle that holds the molten metal. The present invention comprises identifying, using an optimization technique, a flow rate coefficient, a liquid density, and a pouring start angle that is the tilting angle of the pouring ladle at which the flowing out of the molten metal starts. The flow rate coefficient, the liquid density, and the pouring start angle are the control parameters in the mathematical model. The control parameters are identified based on the weight of the liquid that flows out of the pouring ladle and the tilting angle of the ladle that are measured during pouring, and based on a command signal that controls the tilting of the pouring ladle. The present invention also comprises updating the control parameters to match the identified control parameters.

An embodiment of the present invention includes a pouring control method for controlling pouring based on the mathematical model of the pouring process from the input of the control parameters to the pouring using the pouring ladle. The method includes identifying and updating the flow rate coefficient, the liquid density, and the pouring start angle, which are the control parameters within the mathematical model using the optimization technique. Thus, the operation for identification of the parameters, which normally takes much time to complete, can take less time. Also, the control parameters can be updated to the value corresponding to the pouring condition, and the control can deal with changes in pouring conditions. Thus, the accuracy of the pouring can be improved.

Further, since a mathematical model of the pouring process based on fluid mechanics has been derived and since a model-based pouring control system is adopted, which is a pouring control system based on the model, the automatic pouring devices with a tilting-type ladle, each of which devices has a different shape for the pouring ladle and/or a different kind molten metal, can share the common parameter(s). Thereby the system can be booted in a short time and the pouring process analysis can be to carried out in a short time.

An embodiment of the present invention includes a pouring control method, wherein the flow rate coefficient, the liquid density, and the pouring start angle, are identified by optimizing an evaluation function that is represented by the following equation.

$$\{c_{id},\theta_{sid},\rho_{id}\}=\arg\min\{\int_0^T(W_{Lex}(t)-W_{Lsim}(t,c_{sim},\theta_{ssim},\rho_{sim}))^2dt+w_1(c_{avg}-c_{sim})^2+w_2(\rho_{avg}-\rho_{sim})^2\} \quad \text{[Math. 1]}$$

where $c_{id}$ is an identified flow rate coefficient, $\theta_{sid}$ is an identified pouring start angle, $\rho_{id}$ is an identified liquid density, T is the operating time required to pour molten metal into one mold, $W_{Lex}$ is data on the outflow weight from the pouring ladle obtained from the automatic pouring device with a tilting-type ladle, $W_{Lsim}$ is the outflow weight obtained by the simulation with the mathematical model using the ladle tilting angle, $c_{sim}$ is the flow rate coefficient that was used in the simulation, $\theta_{ssim}$ is the pouring start angle that was used in the simulation, $\rho_{sim}$ is the liquid density that was used in the simulation, $C_{avg}$ is the average value of the flow rate coefficients used for the previous cycle, $\rho_{avg}$ is the average value of the liquid densities used for the previous cycle, $w_1$ is is the weight coefficient used to control the variation of the flow rate coefficient for every pouring, and $w_2$ is the weight coefficient used to control the variation of the liquid density for every pouring.

The flow rate coefficient, the liquid density, and the pouring start angle are identified by optimizing an evaluation function that is represented by an above-shown equation. Here, since the evaluation function includes the weight coefficient that adjusts the effect of the flow rate coefficient and the liquid density, the identification of the parameters with a higher degree of accuracy can be made possible and the accuracy of pouring can be improved.

According to another embodiment of the invention, the flow rate coefficient and the liquid density are identified and updated every time one pouring cycle is completed. An approximate function between the identified pouring start angle and the corresponding weight of the liquid within the pouring ladle is calculated and updated after the consecutive pouring processes by the pouring ladle are completed.

According to the embodiment immediately above since the flow rate coefficient and the liquid density are identified, updated, and reflected in the next pouring control every time one pouring cycle is completed, pouring with a higher degree of accuracy can be carried out. In addition, since an approximate function between the pouring start angle and the corresponding weight of liquid within the pouring ladle is calculated and updated after the consecutive pouring processes by the pouring ladle are completed, a calibration curve with a high degree of accuracy can be made, thereby allowing for pouring with a high degree of accuracy.

According to embodiment of the invention, the pouring control method includes an optimization technique which is the Down-hill simplex method.

If the Down-hill simplex method is adopted as the optimization technique, the convergence of parameter(s) is fast and the computational load can be small. Thus, the parameter update time can be preferably short.

An embodiment of the present invention includes a non-transitory storage medium that is readable by a computer in which a program is stored. The program causes the computer to carry out a process for controlling pouring based on a mathematical model of a pouring process from the input of the control parameters to the pouring of molten metal using a pouring ladle in an automatic pouring device with a tilting-type pouring ladle that pours the molten metal into a mold by tilting the pouring ladle that holds the molten metal. The process comprises the following: identifying, using an optimization technique, a flow rate coefficient, a liquid density, and a pouring start angle that is the tilting angle of the pouring ladle at which flowing out of the molten metal starts, wherein the flow rate coefficient, the liquid density, and the pouring start angle are the control parameters in the mathematical model, based on the weight of liquid that flows out of the pouring ladle and the tilting angle of the ladle that are measured during pouring, and a command signal that controls the tilting of the pouring ladle, and updating the control parameters to the identified control parameters.

The pouring control method of the present invention can be applied to a pouring control program that causes the computer to carry out the control method by using a storage medium that is readable by the computer in which the program is stored.

The basic Japanese patent application, No. 2013-094810, filed Apr. 27, 2013, is hereby incorporated by reference in its entirety in the present application.

The present invention will become more fully understood from the detailed description given below. However, the detailed description and the specific embodiments are only illustrations of the desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

DESCRIPTION OF EMBODIMENTS

The pouring control method of the present invention is explained by reference to the Figures.

Figure 1:
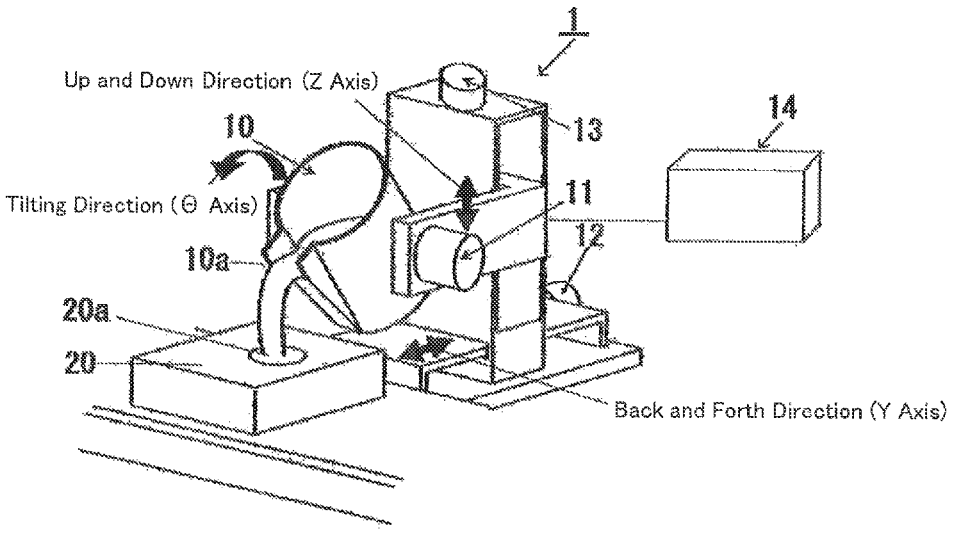
FIG. 1 is a schematic perspective view that shows one example of the automatic pouring device with the tilting-type ladle.

An example of the automatic pouring device with a tilting-type ladle that employs the pouring control method of the present invention is shown in FIG. 1. The automatic pouring device with a tilting-type ladle 1 (hereafter, "automatic pouring device 1") comprises a pouring ladle 10 and servomotors 11, 12, and 13. The pouring ladle 10 carries molten metal. One of the servomotors is a servomotor 11 that tilts and also turns the ladle 10 around an axis θ. Another servomotor 12 moves the ladle 10 back and forth. The third servomotor 13 moves the ladle 10 up and down.

Since the servomotors 11, 12, and 13 each have rotary encoders, the position and the tilting angle of the pouring ladle 10 can be determined. The servomotors 11, 12, and 13 are configured to be given a command signal from a "computer". The computer in this specification denotes a motion controller such as a personal computer, a micro computer, a programmable logic controller (PLC), or a digital signal processor (DSP).

A load cell is arranged at the lower end of a rigid structure that includes the pouring ladle 10 or at the lower end of the automatic pouring device 1, to measure the weight of the pouring ladle 10 that includes the liquid.

By using the above-mentioned configuration, the automatic pouring device 1 can discharge the molten metal from the lip of the pouring ladle 10*a*, and pour the molten metal inside a mold 20 through a sprue of the mold 20*a* by controlling the servomotors 11, 12, and 13 to convey the pouring ladle 10 along a predetermined track.

Figure 2:
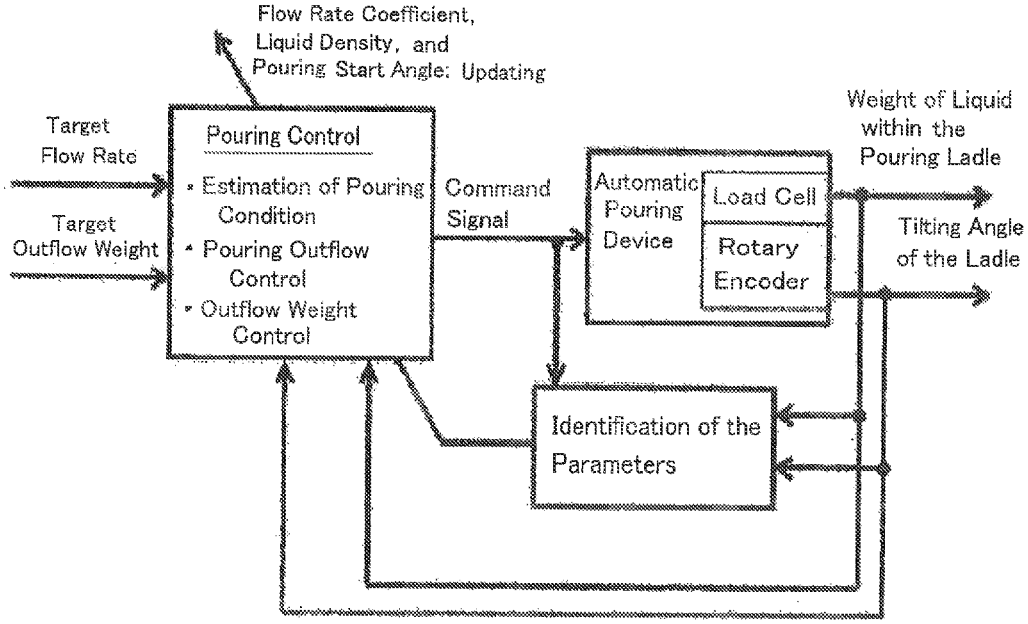
FIG. 2 is a block diagram of the pouring control method.

A mathematical model of the pouring process in the automatic pouring device 1 based on fluid mechanics will be derived here to build a model-based pouring control system that is a pouring control system based on the mathematical model. FIG. 2 shows a configuration example of the model-based pouring control system. Here, FIG. 2 shows a two-degree-of-freedom type pouring control system in which a feedforward control and a feedback control are incorporated.

Once the computer 14 is given the desirable target outflow weight and the target pouring flow rate pattern, the computer 14 adjusts and outputs the command signal to the automatic pouring device 1 to achieve the target pouring flow rate and the target outflow weight, where the command signal may become the speed command and/or the position commands, depending on the control mode of the servomotors 11, 12, and 13. In addition, various aspects, such as voltage and pulses, can be adopted as the command signal.

When pouring, the tilting angle of the ladle is measured by the rotary encoder, and the weight of the liquid within the pouring ladle is measured by a load cell provided on the automatic pouring device 1. The outflow weight of the liquid that outflows from the pouring ladle 10 can be measured by calculating the difference between the weight of the liquid within the pouring ladle before pouring and the weight of the liquid within the pouring ladle during the pouring.

The measured tilting angle of the ladle and weight of liquid within the pouring ladle are output to the computer 14. The computer 14 controls the pouring operation based on them. Incidentally, the pouring control system in FIG. 2 may become a feedforward-type pouring control system by removing the feedback loop in FIG. 2.

The computer 14 identifies and updates the model parameters based on the command signal, and the acquired tilting angle of the ladle and weight of the liquid within the pouring ladle. The pouring control system generates the command signals for the servomotors 11, 12, and 13, depending on the model parameters, by acquiring the command signal, the weight of liquid within the pouring ladle, and the tilting angle of the ladle that are detected through one pouring operation, by using these data and the mathematical model of the pouring process to identify the flow rate coefficient, the liquid density, and the pouring start angle, which are the model parameters of the pouring process, and by updating the model parameters within the pouring control.

Figure 3:
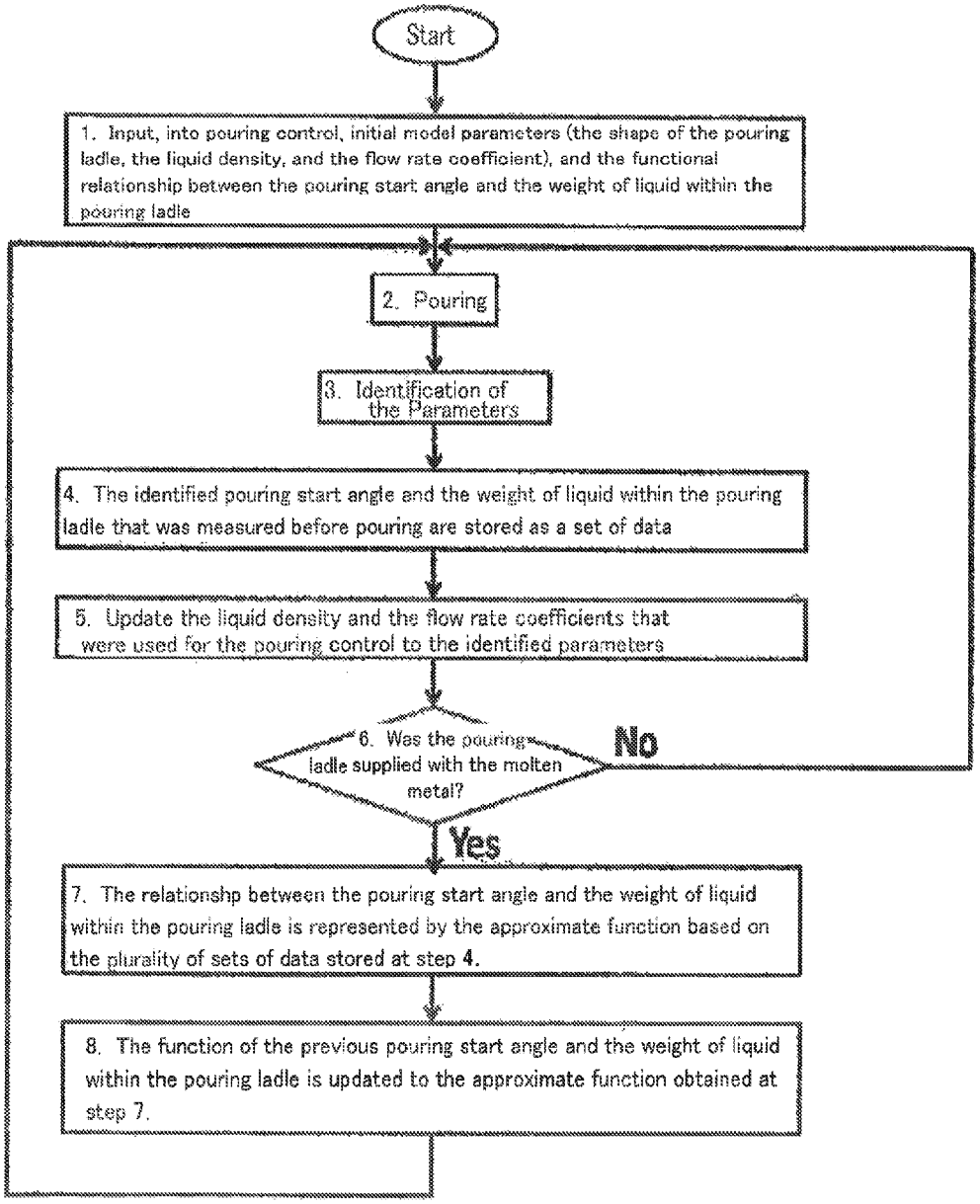
FIG. 3 is a flowchart that shows the pouring control method for identifying and updating parameters.

Next, based on the flowchart of FIG. 3, the identification and update process of the model parameters will be explained. At step 1, the initial model parameters and functional relationship (calibration curve) between the pouring start angle and the weight of the liquid within the pouring ladle are given the pouring control as parameters set for the pouring control. The pouring start angle is the tilting angle of the pouring ladle 10, at which a flow out of the molten metal begins. The initial model data as the initial model parameters include the shape of the pouring ladle, the liquid density, and the flow rate coefficient. The values that are employed for the pouring ladle design are used as data on the shape of the pouring ladle. The values that are considered to be appropriate through experiments and/or experience are used for the liquid density and the flow rate coefficient. The functional relationship between the pouring start angle and the weight of liquid within the pouring ladle can be obtained by calculating the volume of the liquid with which the pouring ladle is filled, which corresponds to the tilting angle of the ladle from data on the shape of the pouring ladle, multiplying the volume by the liquid density, and formulating the function. Incidentally, it is assumed that the pouring ladle 10 at this stage is already supplied with the molten metal and is ready to carry out the pouring operation.

At step 2, the pouring machine is controlled based on the mathematical model discussed below, and the pouring from the pouring ladle 10 into the mold 20 is carried out.

At step 3, the liquid density and the flow rate coefficient are identified as parameters to be updated by using an optimization technique explained later based on the outflow weight from the pouring ladle 10, the tilting angle of the ladle, and the command signal data that are acquired during a pouring operation from the pouring ladle 10 into a mold 20.

At step 4, the identified pouring start angle and the weight of the liquid within the pouring ladle that were measured before pouring are stored as a set of data in the computer 14.

At step 5, the liquid density and the flow rate coefficients that were input as the initial parameters to the pouring control and were used for the pouring control are updated online so that they are replaced by the liquid density and the flow rate coefficient, respectively, that were identified at step 3.

At step 6, the computer 14 determines whether the pouring ladle 10 was supplied with the molten metal after or at step 2. If the pouring ladle 10 was not supplied with the molten metal (step 6: No), step 2 is carried out so that the pouring ladle 10 continues to pour the molten metal from the pouring ladle 10 to the mold 20. Thereby the liquid density and the flow rate coefficient are updated every time the pouring ladle 10 pours the molten metal.

If the pouring ladle 10 is supplied with the molten metal (step 6: Yes), a cycle of pouring has been completed and then step 7 takes place.

At step 7, the relationship between the pouring start angle and the weight of the liquid within the pouring ladle is represented by the approximate function based on a plurality of sets of data acquired from respective data sequences. The sequences are "the identified pouring start angle and the weight of liquid within the pouring ladle that were measured before pouring" that were acquired at step 4 every time the pouring ladle 10 pours the molten metal.

At step 8, the approximate function of the previous pouring start angle and the weight of the liquid within the pouring ladle is updated to the approximate function obtained at step 7. At a new cycle of pouring, that approximate function is used for the pouring control.

Repeating the above process allows for rapid handling of a change in the pouring environment, and for the pouring control with a high degree of accuracy, depending on the pouring condition.

Below, the mathematical model of a pouring process based on fluid mechanics that is used when a parameter identification technique is built is shown. As the pouring control system based on such a mathematical model, the inventors propose the model-based pouring control system that is shown in Patent documents 4 and 5. First, a mathematical model from the command signal u [V] to the tilting angle θ [rad] of the ladle that is used at step 2 of the pouring control is shown in Equation (2).

[Math. 2]

$$\frac{d}{dt}\begin{bmatrix}\theta(t)\\ \omega(t)\end{bmatrix}=\begin{bmatrix}0 & 1\\ 0 & -\frac{1}{T_m}\end{bmatrix}\begin{bmatrix}\theta(t)\\ \omega(t)\end{bmatrix}+\begin{bmatrix}0\\ \frac{K_m}{T_m}\end{bmatrix}u(t), \tag{2}$$

where equation (2) shows the speed control mode, ω [rad/s] denotes the tilting angular speed of the ladle, $T_m$ [s] denotes a time constant of the motor system, and $K_m$ [m/s/V] denotes a gain constant. When the servomotors are in a position control mode, the equation is represented in the form of equation (2), to which the position feedback mechanism is added.

The mathematical model from the tilting angular speed ω of the ladle to the pouring flow rate $q_c$ [$m^3$/s] is represented by equation (3) and equation (4).

[Math. 3]

$$\frac{dh(t)}{dt}=-\frac{q_c(h(t))}{A(\theta(t))}-\left\{\frac{h(t)}{A(\theta(t))}\frac{\partial A(\theta(t))}{\partial\theta(t)}+\frac{1}{A(\theta(t))}\frac{\partial V_s(\theta(t))}{\partial\theta(t)}\right\}\omega(t), \quad (\theta(t)\geq\theta_s) \tag{3}$$

-continued

[Math. 4]

$$q_c(t)=c\int_0^{h(t)}L_f(h_b)\sqrt{2gh_b}\,dh_b,\ (h(t)\geq 0) \tag{4}$$

Figure 4:
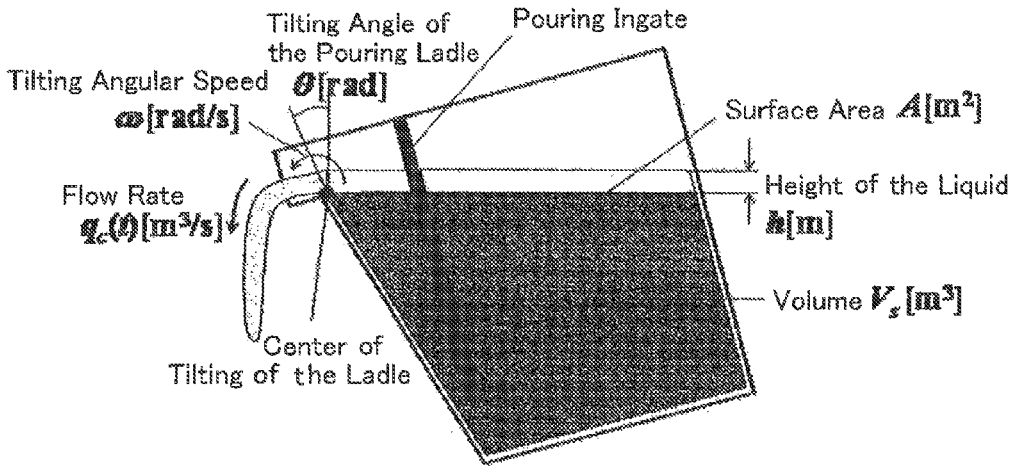
FIG. 4 is a schematic cross-sectional view of the pouring ladle.
Figure 5:
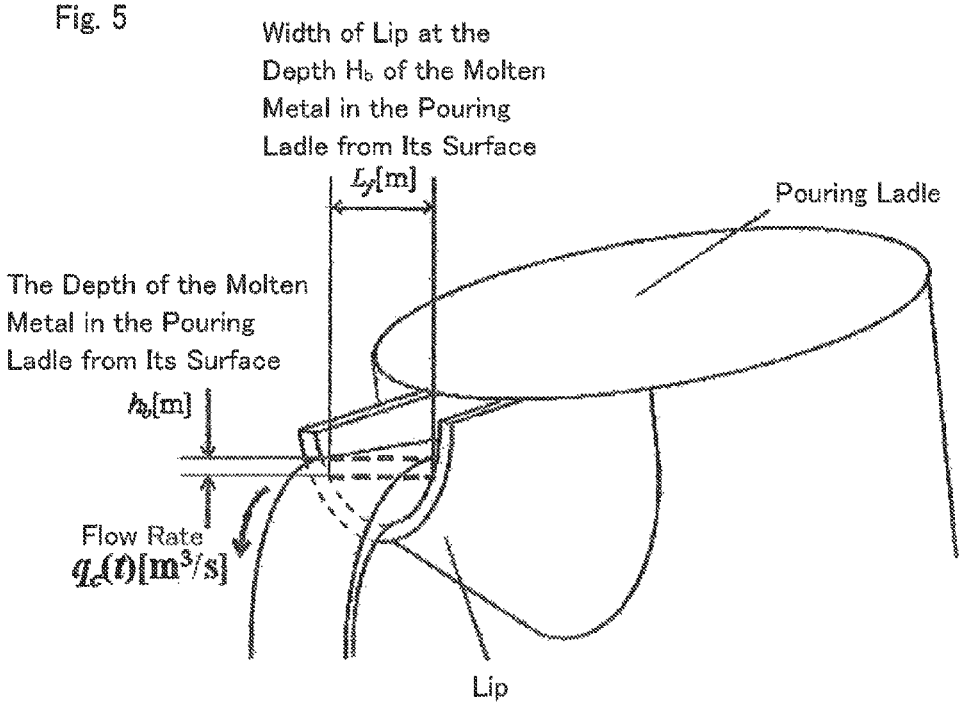
FIG. 5 is a schematic perspective view that shows the tip end of the lip of the pouring ladle.

As is shown in FIG. 4, the symbol h[m] in equation (3) shows the level of the liquid above the lip of the pouring ladle. The symbol A [$m^2$] denotes the surface area of the upper surface of the liquid within the pouring ladle, and $V_s$ [$m^{3]}$ denotes the volume of the part of the liquid that is lower than the lip of the pouring ladle. The symbol θ [rad] denotes the tilting angle of the pouring ladle. Equation (3) is useful when the upper surface of the liquid within the pouring ladle is located above the lower surface of the lip of the pouring ladle, and when the tilting angle θ [rad] is equal to or larger than the tilting angle $\theta_s$ [rad] of the ladle when the liquid within the pouring ladle begins to flow out. The ladle tilting angle θ denotes the pouring start angle. Also, $L_f$ [m] of equation (4) represents the width of the lip of the pouring ladle at the depth $h_b$ [m] of the liquid in the pouring ladle from its surface as shown in FIG. 5. The symbol g [m/$s^2$] denotes the acceleration of gravity. The symbol c denotes the flow rate coefficient. Equation (4) is useful when the height of the liquid within the pouring ladle is above the lower surface of the lip of the pouring ladle.

Equation (5) shows the relationship between the outflow weight W [kg] and the flow rate $q_c$ [$m^3$/s] of the molten metal.

[Math. 5]

$$\frac{dW}{dt}=\rho q_c, \tag{5}$$

where the symbol ρ [kg/$m^3$] shows the liquid density. The outflow weight W [kg] is measured by the load cell built in the automatic pouring device 1. The response delay in the load cell is represented using the first order lag of equation (6).

[Math. 6]

$$\frac{dW_L(t)}{dt}=-\frac{1}{T_L}W_L(t)+\frac{1}{T_L}W(t) \tag{6}$$

Where the symbol $W_L$ [kg] is the outflow weight measured by the load cell, and the symbol $T_L$ [s] denotes the time constant corresponding to the response in the load cell.

Equations (2) to (6) are represented as a mathematical model of the automatic pouring device 1. The tilting angle θ [rad] of the ladle is detected by the rotary encoder, and the outflow weight $W_L$ [kg] is detected by the load cell. The pouring control system is built using the mathematical model of this automatic pouring device 1. When the feed-forward-type pouring flow rate control is carried out using the inverse model, if the desirable pouring flow rate pattern $q_{cref}$ [$m^3$/s] is given, the inverse function of equation (4) allows the height of the liquid $h_{ref}$ [m] to be obtained that can achieve the desirable pouring flow rate pattern shown in equation (7).

[Math. 7]

$$h_{ref}(t)=f^{-1}(q_{cref}(t)) \tag{7}$$

Here, we can adopt a technique of obtaining the inverse function of equation (7) by applying polynomial approximation to the inverse function of equation (4) and/or by making equation (4) be adapted to finite dimensions and linearly-interpolating values between elements in order to derive equation (7).

The tilting angular speed $\omega_{ref}$ [rad/s] of the ladle that achieves a desirable pouring flow rate pattern $q_{cref}$ [$m^3$/s] can be obtained by substituting the obtained height of the liquid $h_{ref}$ [m] into equation (8), derived from equation (3).

[Math. 8]

$$\omega_{ref}(t) = -\left\{\frac{dh_{ref}(t)}{dt} + \frac{q_{conf}(t)}{A(\theta_{ref}(t))}\right\} \left\{\frac{h_{ref}(t)}{A(\theta_{ref}(t))}\frac{\partial A(\theta_{ref}(t))}{\partial\theta(t)} + \frac{1}{A(\theta_{ref}(t))}\frac{\partial V_s(\theta_{ref}(t))}{\partial\theta(t)}\right\}^{-1} \tag{8}$$

Reference tilting angle $\theta_{ref}$ [rad] in equation (8) can be obtained from equation (9), where equation (2) is used. $\theta_{sref}$ [rad] in equation (9) denotes the pouring start angle. It is the tilting angle of the ladle at which the liquid begins to flow out of the pouring ladle.

[Math. 9]

$$\theta_{ref}(t)=\int_0^t\omega_{ref}(t)dt+\theta_{sref} \tag{9}$$

The tilting angular speed $\omega_{ref}$ [rad/s] of the ladle obtained in equation (8) is realized by using the command signal $u_{ref}$ [V], which is derived using the inverse-model of the motor model shown in equation (2). The inverse-model of the motor model is shown in equation (10).

[Math. 10]

$$u_{ref}(t) = \frac{T_m}{K_m}\frac{d\omega_{ref}(t)}{dt} + \frac{1}{K_m}\omega_{ref}(t) \tag{10}$$

A feedforward-type pouring flow rate control can be built using equations (7) to (10). Here, in the feedforward-type pouring flow rate control, the height of the liquid $h_{ref}$ [m] is required to be twice-differentiable.

When a two degree of freedom pouring flow rate control into which the feedforward control and the feedback control are incorporated is built, the two degree of freedom pouring flow rate control can be built as one technique, based on the flatness shown below. If the flat output F is the height of the liquid h, the feedback linearization mechanism of equation (11) is built based on equation (3).

[Math. 11]

$$u(t) = -\frac{1}{K_m}\{A(\theta(t))v(t) + q_c(F(t))\}\left\{\frac{\partial A(\theta(t))}{\partial\theta(t)}F(t) + \frac{\partial V_s(\theta(t))}{\partial\theta(t)}\right\}^{-1} \tag{11}$$

Here, assuming that the responsiveness of the motor is much better than that of the pouring process, $u=K_m\omega$ can be represented without considering the dynamic characteristic of the motor. Thus, equation (11) can be obtained. Equation (11) allows the model from the new control input v to the height of the liquid h(=F) at the lip of the pouring ladle to be linearized as shown in equation (12).

[Math. 12]

$$\frac{dF(t)}{dt} = v(t) \tag{12}$$

Thus, the feedback control mechanism in equation (13) is built for the new control input v.

[Math. 13]

$$v(t) = \frac{dF^*(t)}{dt} - K_p(F(t) - F^*(t)) - K_i\int(F(t) - F^*(t))dt, \tag{13}$$

where the symbol F* denotes the desirable target height of the liquid ($F^*=h_{ref}$), and the symbols $K_p$ and $K_i$ are control parameters that adjust the performance of the following target value that makes the actual height of the liquid h follow the target height of the liquid $h_{ref}$. The desirable pouring flow rate $q_{cref}$ is given. The height of the liquid $h_{ref}$ that achieves the desirable pouring flow rate can be obtained from equation (7). The two degree of freedom pouring flow rate control in equations (11) and (12) is carried out based on the height of the liquid $h_{ref}$. Here, the height of the liquid $h_{ref}$ is required to be a once differentiable function when the two degree of freedom pouring flow rate control is carried out. Also, equation (11) is useful as well as the feedforward-type pouring flow rate control, when the tilting angle θ of the ladle is equal to or greater than the pouring start angle $\theta_s$.

The two kinds of pouring flow rate controls shown in above are both model-based pouring flow rate controls, which are based on the mathematical model of the pouring process. Here, many of the model parameters are set depending on the shape of the pouring ladle. However, since the flow rate coefficient c depends on the characteristics of the liquid and the characteristics of the surface texture of the pouring ladle, the parameters need to be identified by experiments. Moreover, although the pouring start angle $\theta_s$ can be obtained by deriving the volume of the liquid from the weight of the liquid within the pouring ladle before pouring and by using the volume of the liquid and the shape of the pouring ladle, a difference from the model due to the effects of the fluctuation of the shape of the ladle caused by accumulating slag could occur. Moreover, since the liquid density ρ of the high-temperature molten metal is likely to fluctuate depending on the temperature, the molten metal is susceptible to the pouring environment. Then, as shown in FIG. 2, a technique of identifying the flow rate coefficient, the pouring start angle, and the liquid density can be built based on the outflow weight data on the liquid, data on the tilting angle of the ladle, and the command signal data, which are obtained by using the automatic pouring.

The parameter identification at step 7 is carried out by minimizing the evaluation function in equation (14). Specifically, it is minimized by applying the Down-hill simplex method as an optimization technique to the evaluation function in equation (14). Here, when the Down-hill simplex method is used, the convergence of the parameter(s) is fast and the computational load can be small. Thus, the parameter update time can be preferably short. In addition, optimization techniques such as a genetic algorithm, or a sequential quadratic programming approach, can be adopted.

[Math. 14]

$$\{c_{id},\theta_{sid},\rho_{id}\}=\arg\min\{\int_0^T(W_{Lex}(t)-W_{Lsim}(t,c_{sim},\theta_{ssim},\rho_{sim}))^2dt+w_1(c_{avg}-c_{sim})^2+w_2(\rho_{avg}-\rho_{sim})^2\} \tag{14},$$

where the symbol T [s] denotes the pouring motion time of the automatic pouring device 1 that pours the molten metal into one mold, $W_{Lex}$ [kg] denotes the weight data on the outflow from the pouring ladle that the automatic pouring device 1 obtains through the built-in load cell, $W_{Lsim}$

[kg] denotes the weight of the outflow that is obtained when the simulation is carried out through the mathematical model of equations (2) to (6) by using the command value sent to the motor and the ladle tilting angle that is measured by the rotary encoder. The symbols $c_{sim}$, $\theta_{ssim}$, and $\rho_{sim}$ denote the flow rate coefficient, the pouring start angle, and the liquid density, respectively, that were used in the simulation. The symbols $C_{avg}$ and $\rho_{avg}$ denote averaged values of flow rate coefficients and liquid densities, respectively, that were used until the previous cycle, and are represented as equations (15) and (16), respectively.

[Math. 15]

$$c_{avg} = \frac{1}{N}\sum_{i=1}^{N} c_{id}(k-i) \tag{15}$$

[Math. 16]

$$\rho_{avg} = \frac{1}{N}\sum_{i=1}^{N} \rho_{id}(k-i), \tag{16}$$

where the symbol k denotes the number of times a pouring is carried out, and N denotes the number of pourings to be averaged. When the flow rate coefficient and/or the liquid density of the liquid to be poured are constant, N can be set to the maximum number of the pourings. However, when high temperature molten metal is used, the flow rate coefficient and/or the liquid density, may vary, depending on the temperature characteristics. Thus, adjusting the number of N and deleing the identified data obtained by the past pouring allow the accuracy of the identified data to improve.

The symbol $w_1$ in equation (14) denotes a weight coefficient for controlling the variation of the flow rate coefficient for every pouring. The symbol $w_2$ denotes a weight coefficient for controlling the variation of the liquid density for every pouring. Increasing these allows the variation of the flow rate coefficient and liquid density that are identified for every pouring to be low. Since an adjustment of the weight coefficient allows the effect on the flow rate coefficient and the liquid density to be adjusted, the parameter identification with a higher accuracy can be made possible and the accuracy of pouring can be improved. For example, when the effect of the temperature in the liquid density is significant, it is recommended that the value of $w_2$ be set to be small.

An identified pouring start angle $\theta_{sid}$ [rad] is combined with the weight of the liquid within the pouring ladle $W_b$ [kg] before the pouring that is measured by the load cell to be a set, and is stored as a set of the identified pouring start angle and the weight of the liquid within the pouring ladle in the computer 14. The molten metal can generally be poured a plurality of times from the automatic pouring machine that is supplied with the molten metal once. The pouring start angle can be estimated from the weight of the liquid within the pouring ladle measured before the pouring by making the approximate function using the data sequence of the pouring start angles $\theta_{sid}=(\theta_{sid}(1), \theta_{sid}(2), \ldots \theta_{sid}(n))$ that are identified for every pouring and the data sequence of the weight of liquid within the pouring ladle before pouring $W_b=(W_b(1), W_b(2), \ldots W_b(n))$. The linear approximation and/or the polynomial approximation are often used as an approximate function.

In addition, the present invention can be applied to the non-transitory medium. It is readable by a computer in which a pouring control program is stored. The program causes the computer to carry out the above-explained process. That is to say, the present invention can be applied to a non-transitory medium that is readable by a computer in which a program is stored. The program causes the computer to carry out a process for controlling pouring based on a mathematical model of a pouring process from the input of at least one control parameter to pouring of molten metal using a pouring ladle in an automatic pouring device with a tilting-type ladle that pours the molten metal into a mold by tilting the pouring ladle that holds the molten metal. The process comprises the following:

identifying, using an optimization technique, a flow rate coefficient, a liquid density, and a pouring start angle that is a tilting angle of the pouring ladle at which a flow out of the molten metal starts, wherein the flow rate coefficient, the liquid density, and the pouring start angle are the control parameters in the mathematical model, based on the weight of the liquid that flows out of the pouring ladle and ladle tilting angle that are measured during pouring, and a command signal that controls the tilting of the pouring ladle, and updating the control parameters to the identified control parameters.

[Effects of the Embodiments]

The pouring control method of the present invention includes a pouring control method for controlling pouring based on the mathematical model of the pouring process from the input of the control parameters to the pouring using the pouring ladle. As the method includes identifying and updating the flow rate coefficient, the liquid density, and the pouring start angle that are control parameters within the mathematical model using the optimization technique, the operation for identification of the parameters, which normally takes much time to complete, can take less time. And the control parameters can be updated to the value corresponding to the pouring condition. And the control can deal with changes in the pouring conditions. Thus, the accuracy of pouring can be improved.

Further, since the mathematical model of the pouring process based on fluid mechanics has been derived, and a model-based pouring control system has been adopted that is a pouring control system based on the model, the automatic pouring devices with a tilting-type ladle, each of which devices has a pouring ladle with a different shape and/or a different kind molten metal, can share the common parameter(s). Thereby the system can be booted in a short time and can carry out the pouring process analysis.

Further, the present invention can be applied to a non-transitory medium that is readable by a computer in which the pouring control program is stored, where the program causes the computer to carry out the above explained process.

Examples of Experiments

We carried out the experiments of pouring to indicate the usefulness of the pouring control method of the present invention. The experiment conditions are the following:

Shape of pouring ladle: Sector form pouring ladle
Used liquid: water
Target outflow weight: 1.55 kg
Target pouring flow rate (stationary time): $5\times10^{-4}$ $m^3/s$
Pouring control: feedforward-type pouring flow rate control
A weight coefficient $w_1$: 3
A weight coefficient $w_2$: 0.01

Figure 6:
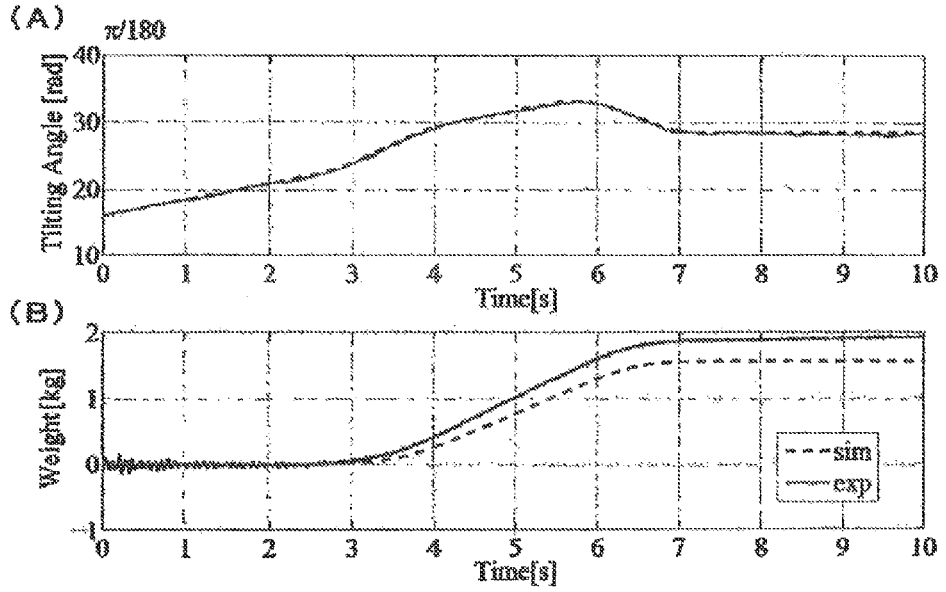
FIG. 6 is a schematic diagram that shows the result of a pouring experiment.
Figure 7:
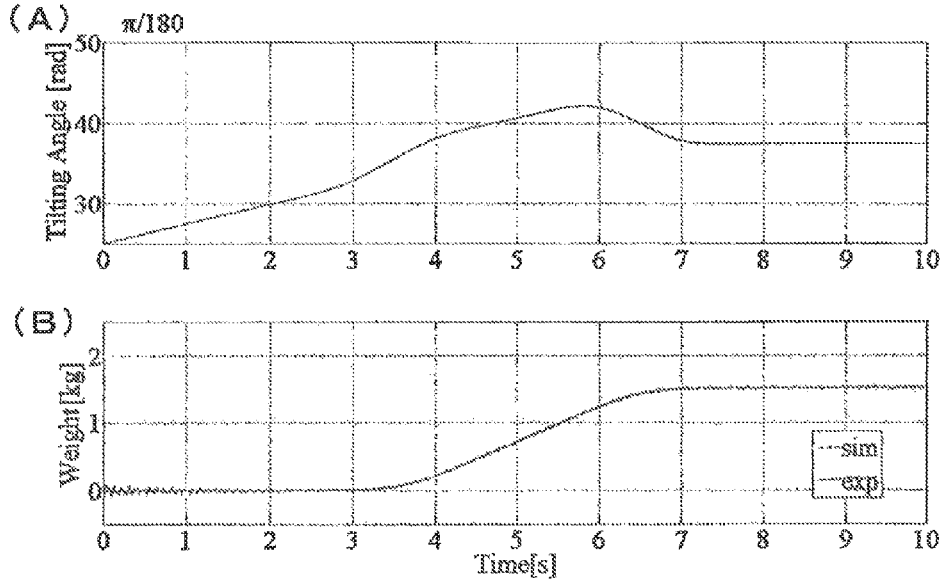
FIG. 7 is a schematic diagram that shows the result of a pouring experiment.

The experimental results are shown in FIGS. 6 and 7. FIG. 6 shows the result of the first time pouring experiment. The flow rate coefficient and the liquid density are given appropriately and the pouring start angle, corresponding to the weight of the liquid within the pouring ladle obtained from the drawing of the shape of the pouring ladle, is used. FIG. 7 shows the result of the fourth pouring experiment. The pouring control is carried out after the parameters are identified and updated. After being poured three times, the liquid is again supplied into the pouring ladle. FIG. 6 (A) and FIG. 7 (A) show the ladle tilting angle measured by the rotary encoder, and FIG. 6 (B) and FIG. 7 (B) show the outflow weight measured by the load cell. The solid line shows the experimental result, and the dashed line shows the simulation result obtained using the mathematical model of the pouring process.

In the first experiment for pouring, shown in FIG. 6, with regard to the initial parameters used for the pouring control, the flow rate coefficient is 0.98, the liquid density is $1\times10^3$ [kg/m$^3$], and the pouring start angle is $21.70\times\pi/180$ [rad]. On the result of the parameters that are identified after the experiment of the first pouring, the flow rate coefficient is 0.98, the liquid density is $1\times10^3$ [kg/m$^3$], and the pouring start angle is $20.20\times\pi/180$ [rad]. A comparison before and after the parameter identification shows that the difference is small for the flow rate coefficient and the liquid density, but the difference is large for the pouring start angle.

This difference of the pouring start angles affects the difference between the simulation result of the outflow weight and the experimental result shown in FIG. 6 (B). In the fourth pouring, where the pouring control was carried out after the parameter shown in FIG. 7 was identified and updated, the flow rate coefficient used for the pouring control was 0.99, the liquid density was $1\times10^3$ [kg/m$^3$], and the weight of the liquid within the pouring ladle was 5.58 kg. Thus, $30.86\times\pi/180$ [rad] was used as the estimated value of the pouring start angle. When the parameter was identified after the fourth pouring experiment, the flow rate coefficient that was used for the pouring control was 0.99, the liquid density was $1\times10^3$ [kg/m$^3$], and the pouring start angle was $30.90\times\pi/180$ [rad]. Since the flow rate coefficient, the liquid density, and the pouring start angle that were used for the pouring control were almost the same as those of the results of the parameter identification, and the parameters that are suitable for the pouring condition were used for the pouring control, it was confirmed that the result of the experiment matched that of the simulation, and that the liquid was poured with a high degree of accuracy.

Figure 8:
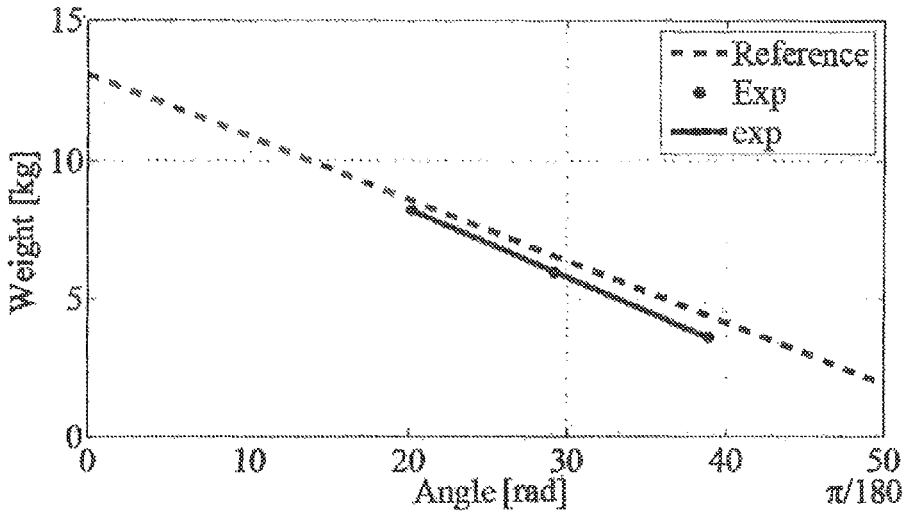
FIG. 8 is a schematic diagram that compares the result obtained from the shape of the pouring ladle with the approximate function with regard to the relationship between the pouring start angle and the weight of the liquid within the pouring ladle before pouring.

The relationship between the weight of the liquid within the pouring ladle before pouring and the pouring start angle is shown in FIG. 8. The dashed line shows the relationship between the weight of liquid within the pouring ladle and the pouring start angle that is obtained using the pouring ladle. The black circle mark "•" shows the identified pouring start angle and weight of the liquid within the pouring ladle before pouring. The solid line shows the results of identification, which is approximately linear. The linearly approximated relationship between the weight of liquid within the pouring ladle and the pouring start angle is shown in equation (17).

[Math. 17]

$$\Theta_s=-4.046W_b+53.4332 \tag{17}$$

In the fourth experiment of pouring, the pouring start angle is predicted using the linearly approximated relationship between the weight of the liquid within the pouring ladle before pouring and the pouring start angle. It is found from FIG. 8 that the pouring start angle obtained using the figure of the shape of the pouring ladle is much different than the pouring start angle obtained using the parameter identification. This difference is considered to be caused by an error in modeling due to the simplification of the shape when the pouring start angle is derived from the figure of the shape of the pouring ladle and the change over the years of the shape of the pouring ladle. The pouring control method of the present invention allows us to grasp the relationship between the accurate pouring start angle and the weight of the liquid within the pouring ladle before pouring, and to employ it for the pouring control.

As shown above, it was confirmed that pouring with a high degree of accuracy can be achieved by using the pouring control method of the present invention.

DESCRIPTION OF THE REFERENCE NUMERALS

1 an automatic pouring device
10 a pouring ladle
10*a* a lip of the pouring ladle
11, 12, 13 servomotors
14 a computer
20 a mold
20*a* a sprue of the mold

The invention claimed is:

1. A pouring control method for controlling pouring based on a mathematical model of a pouring process from input of control parameters to pouring of molten metal using a pouring ladle in an automatic pouring device with a tilting pouring ladle that pours the molten metal into a mold by tilting the pouring ladle that holds the molten metal, comprising: identifying, using an optimization technique, a flow rate coefficient, a liquid density, and a pouring start angle that is a tilting angle of the pouring ladle at which a flow out of the molten metal starts, wherein the flow rate coefficient, the liquid density, and the pouring start angle are the control parameters in the mathematical model, based on weight of liquid that flows out of the pouring ladle and tilting angle of the ladle that are measured during pouring, and a command signal that controls the tilting of the pouring ladle, and updating the control parameters to the identified control parameters, wherein the flow rate coefficient the liquid density, and the pouring start angle are identified by optimizing an evaluation function that is represented by a following equation, $$\{c_{id},\theta_{sid},\rho_{id}\}=\arg\min\{\int_0^T(W_{Lex}(t)-W_{Lsim}(t,c_{sim},\theta_{ssim},\rho_{sim}))^2dt+w_1(c_{avg}-c_{sim})^2+w_2(\rho_{avg}-\rho_{sim})^2\},$$

where $c_{id}$ is an identified flow rate coefficient, $\theta_{sid}$ is an identified pouring start angle, $\rho_{id}$ is an identified liquid density, T is operating time required to pour molten metal into one mold, $W_{Lex}$ is data on outflow weight from the pouring ladle obtained from the automatic pouring device with a tilting-type ladle, $W_{Lsim}$ is outflow weight obtained by the simulation with the mathematical model using the lade tilting angle, $c_{sim}$ is a flow rate coefficient that was used in the simulation, $\theta_{ssim}$ is a pouring start angle that was used in the simulation, $\rho_{sim}$ is a liquid density that was used in the simulation, $C_{avg}$ is an average value of flow rate coefficients used until previous time, $\rho_{avg}$ is an average value of liquid densities used until previous time, $w_1$ is a weight coefficient used to control the variation of the flow rate coefficient for every pouring, and $w_2$ is a weight coefficient used to control the variation of the liquid density for every pouring.

2. The pouring control method according to claim 1, wherein the flow rate coefficient and the liquid density are identified and updated every time one pouring is completed, and wherein an approximate function between the identified pouring start angle and a corresponding weight of liquid within the pouring ladle is calculated and updated after the consecutive pouring processes by the pouring ladle are completed.

3. The pouring control method according to claim 1, wherein the optimization technique is a Down-hill simplex method.

4. The pouring control method according to claim 2, wherein the optimization technique is a Down-hill simplex method.

* * * * *